US005309032A

United States Patent [19]

Nilssen

[11] Patent Number: 5,309,032

[45] Date of Patent: May 3, 1994

[54] WALL SWITCH TIMER

[76] Inventor: Ole K. Nilssen, Caesar Dr., Barrington, Ill. 60010

[21] Appl. No.: 468,160

[22] Filed: Jan. 22, 1990

Related U.S. Application Data

[63] Continuation of Ser. No. 420,695, Oct. 11, 1989, which is a continuation of Ser. No. 728,678, Apr. 29, 1985, abandoned.

[51] Int. Cl.[5] ..... H01H 3/26; H01H 3/34; H01H 7/00; H01H 7/08

[52] U.S. Cl. ..... 307/140; 307/141; 307/141.4; 200/38 R; 200/38 B

[58] Field of Search ..... 307/150, 140, 141, 141.4, 307/112, 116, 119, 125, 130, 132 R, 139; 315/360, 119, 120; 200/38 R, 38 B, 35 R

[56] References Cited

U.S. PATENT DOCUMENTS

| | | | |
|---|---|---|---|
| 3,555,214 | 1/1971 | Lee et al. | 200/38 DA |
| 3,740,680 | 6/1973 | Schneidinger | 200/33 B X |
| 3,973,251 | 8/1976 | Stephas | 200/38 B X |
| 4,001,527 | 1/1977 | Hulshizer | 200/38 FB |
| 4,171,471 | 10/1979 | Boyles | 200/38 D |
| 4,259,618 | 3/1981 | Nilssen | 307/140 X |
| 4,302,639 | 11/1981 | Lewis et al. | 200/38 R |

*Primary Examiner*—Sharon D. Logan

[57] ABSTRACT

A plug-in timer has a set of input terminals and a set of output terminals as well as a contactor operable to make and/or break electrical connection between these sets of terminals in accordance with a pre-setable 24 hour program. The timer is powered from a small built-in battery, and comprises its own quartz clock and programming-and-control means. The contactor is actuated by a miniature DC motor through a gear and cam arrangement. The operation of the DC motor is controlled by the programming-and-control means, which provides power from the battery to the motor in accordance with a pre-set program; which pre-set program may be modified at any time by way of a keyboard and a numeric display means. The contactor operates by way of hard metal contacts and very little power dissipation occurs within the timer. The timer can be plugged into a special wall switch receptacle and then operates to programmably control the flow of power to the load controlled by this wall switch. Since the timer has its own built-in source of energy and clock, its operation is totally independent of the power line, and it will therefore not be affected by a power failure. With a usage rate of two CONNECT-actuations and two DISCONNECT-actuations per day, plus occasional overrides, the battery will last for years before needing replacement.

49 Claims, 2 Drawing Sheets

WALL SWITCH TIMER

RELATED APPLICATIONS

The present application is a continuation of application Ser. No. 07/420,695 filed Oct. 11, 1989; which is a continuation of application Ser. No. 06/728,678 filed Apr. 29, 1985, now abandoned.

BACKGROUND OF THE INVENTION

1. Field of Invention

The present invention relates to an electronic programmable wall switch timer for use in lieu of an ordinary wall switch, thereby to provide for programmable control of the power provided to the load normally controlled from this wall switch.

2. Prior Art

A couple of types of electronic programmable wall switch timers are available for purchase, and many more types have been described in various publications. The most commonly used type is described in U.S. Pat. No. RE 31,848 to Nilssen.

However, each one of these electronic wall switch timers has at least two significantly limiting characteristics: i) the use a thyristor for controlling the flow of power, and ii) the use of the 60 Hz power line voltage for providing the requisite accurate time base for the programming means.

One limitation associated with the use of a thyristor in a wall switch timer relates to one of the thyristor's likely failure modes, namely the one in which the thyristor changes to become a rectifier. This likely failure mode makes it is hard to obtain U.L. listing for a thyristor-based wall switch timer to be used for loads other than incandescent lamps.

Another limitation associated with the use of a thyristor involves inefficiency: because of the relatively large amount of power dissipation occurring within a thyristor, it is necessary that it be used with a heat sink; which results in significant limitations of the design freedom associated with any timer using a thyristor for power switching.

The main limitation associated with using the 60 Hz power line voltage as the basis for keeping accurate track of time is that of losing timing and/or accuracy of programming as a result of load failure or removal, or due to power failure.

SUMMARY OF THE INVENTION

Brief Description

In its preferred embodiment, subject invention comprises a self-contained programmable plug-in timer having a pair of plug terminals and a mechanical contactor means operable to make and/or break electrical connection between these terminals in accordance with a presetable 24-hour program.

The timer is powered from a small built-in battery, and comprises its own quartz clock and clock-based programming-and-control means. The contactor is actuated by a miniature DC motor through a gear and cam arrangement. The operation of the DC motor is controlled by the programming-and-control means, which provides power from the battery to the motor in accordance with a pre-set program. To provide for accurate positioning of the cam, thereby to achieve proper operation of the contactors, a cam position sensing means is used to provide position control information to the programming-and-control means.

The pre-set program may be modified at any time by way of a keyboard and an electronic numeric display means. When not being used for programming, the display means shows current time-of-day.

The timer has special plug means and may be plugged into a special electrical receptacle; which special receptacle is placed in the wall switch box in lieu of the ordinary wall switch in such a way that the timer may be plugged into this receptacle by way of the aperture of a standard wall switch cover plate. The special plug means is so constituted as to be prevented from being plugged into an ordinary household electric receptacle.

Since the electrical connection made by the contactor is made by way of hard metal contacts, very little power dissipation takes place within the timer, and the amount of power that the timer can safely control is therefore relatively large.

Since the timer has its own built-in source of energy and accurate clock, its operation is totally independent of the power line and will therefore not be affected by a power failure—however long.

Based on an anticipated usage rate of two ON-actuations and two OFF-actuations per day, plus occasional over-rides, the battery will last for years before needing replacement.

BRIEF DESCRIPTION OF THE DRAWINGS

FIG. 1*a* shows a view predominantly from the rear; and FIG. 1*b* shows a view predominantly from the front.

DESCRIPTION OF THE PREFERRED EMBODIMENT

Details of Construction

FIG. 1*a* shows a view predominantly from the rear of the programmable timer T. Positioned substantially in the middle of the rear of timer T is a pair of prongs P1 and P2 operable to be plugged into and to be held by a special electrical receptacle. On the side of the timer is shown a cut-out switch COS operable to be positioned in an A-position (shown) or in a B-position.

FIG. 1*b* shows a view predominantly from the front of the timer. Positioned near the top of the front is a numeric display means NDM. Positioned below this display means are two relatively large-size program over-ride keys PORK1 and PORK2; and below these over-ride keys is located a set of nine calculator-type programming keys PK1 to PK9.

Figure 2:
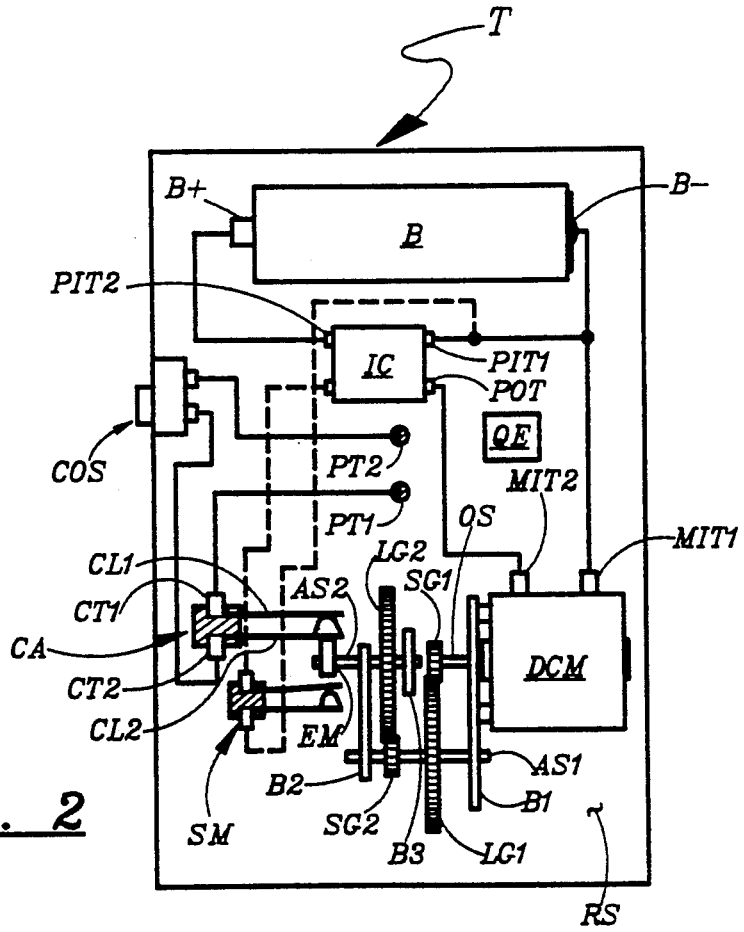
FIG. 2 represents a frontal view of the key components comprised within the timer.

FIG. 2 shows a schematic frontal view of the inside of the timer. A miniature DC motor DCM has two electrical power input terminals MIT1 and MIT2 and is mounted onto a first bracket B1 that is fastened to rear surface RS. On the output shaft OS of this DC motor is mounted a first small gear SG1. This first small gear SG1 is engaged with a first large gear LG1; which first large gear is mounted on a first auxiliary shaft AS1 that is rotatably mounted between first bracket B1 and a second bracket B2 that is also fastened to rear surface RS. Also mounted onto auxiliary shaft AS1 is a second small gear SG2.

Second small gear SG2 is engaged with a second large gear LG2 mounted on a second auxiliary shaft AS2; which second auxiliary shaft is rotatably mounted between second bracket B2 and a third bracket B3, also fastened onto rear surface RS.

Mounted onto an extension of second auxiliary shaft AS2 is a cam or an eccentric means EM that operates a contactor assembly CA that consists of a first contactor lever CL1 and a second contactor lever CL2. Eccentric means EM, which is made of electrically non-conductive material, is shown in a position wherein it causes first contactor lever CL1 to come into contact with second contactor lever CL2.

Eccentric means EM also operates a switch means SM, which is located in a position on the other side of eccentric means EM as compared with the location of contactor assembly CA.

As output shaft OS rotates, contactor lever CL1 makes contact with contactor lever CL2 one time for each revolution of eccentric means EM. Similarly, switch means SM is actuated once for each revolution of eccentric means EM.

Contactor assembly CA has two contactor terminals CT1 and CT2. Terminal CT1 is electrically connected with a prong terminal PT1 of prong P1, and terminal CT2 is electrically connected with a prong terminal PT2 of prong P2 by way of cut-out switch COS.

Switch means SM also has two contactor terminals, both of which are connected with an integrated circuit IC.

A battery B has a B− terminal and a B+ terminal, with the B− terminal being of negative polarity with respect to the B+ terminal. The B− terminal is electrically connected with motor input terminal MIT1 and with IC power input terminal PIT 1; the B+ terminal is connected with IC power input terminal PIT2.

Integrated circuit IC and a quartz element QE are located below battery B—in a position that would be relatively close to the numeric display means NDM of FIG. 1*b*. This IC has a relatively large number of electrical terminals, most of which are connected with the quartz element QE, the numeric display means NDM, the programming keys PK1 to PK9, and the program-over-ride keys PORK1 and PORK2. However, for sake of clarity, and also since they form no part of the present invention, the detailed electrical connections between the IC and QE, NDM, PK1 to PK9, PORK1 and PORK2 are not shown.

The detailed design and construction of a programmable clock means based on a quartz-controlled IC and an electronic numeric display means is well known from prior art.

The remaining IC electrical terminals and connections are shown: electrical power input terminal PIT1 is electrically connected with battery terminal B−; electrical power input terminal PIT2 is electrically connected with battery terminal B+; electrical power output terminal POT is electrically connected with motor input terminal MIT2; the two terminals of switch means SM is connected with two terminals on the IC, one of which is the PIT1 terminal and the other one of which is a control input terminal.

To permit the size and shape of the timer to be as compact as desired, it is important that the individual components comprised within the timer be fittingly small. In practical reality, this concern is only important in respect to the battery and the motor.

Thus, the electrical power required to be supplied from the built-in battery must be modest enough to permit this battery to be small enough to reasonably fit within the desired specified dimensions of the timer. Similarly, the mechanical power required to be supplied by the built-in motor must be modest enough to permit this motor to be small enough to reasonably fit within the specified dimensions.

Since a certain amount of energy is required to effect proper actuation of the contactor assembly, the power required is inversely proportional to the time allowed to effect this actuation. Thus, by way of a speed-reducing gear mechanism, it becomes possible to actuate the control lever at an arbitrarily small power level.

By allowing complete actuation of the contactor assembly, from its full-contact or fully-ON position to its no-contact or fully-OFF position, to take about one second from start to finish, the motor power output requirement gets to be acceptably modest; and actuation can then readily be accomplished by way of a substantially conventional miniature DC motor of dimensions no larger than 10mm×20mm×20mm. Correspondingly, the electrical power required by the motor now becomes adequately modest to permit the use of a single ordinary AAA-cell for the built-in battery.

Figure 3:
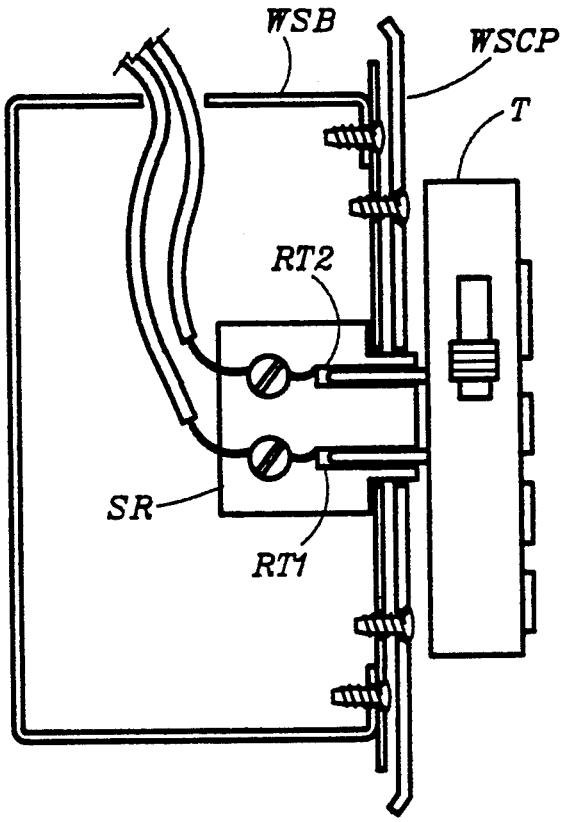
FIG. 3 shows a cross-sectional side-view of a wall switch box having a special receptacle means and with the timer plugged into this receptacle means.

FIG. 3 shows a pseudo-cross-sectional view of timer T plugged into a special receptacle SR mounted in lieu of an ordinary wall switch on a wall switch box WSB. The special receptacle has two receptacle terminals RT1 and RT2, which receptacle terminals are connected with the two wires that otherwise would have been connected with an ordinary wall switch. The receptacle terminals are accessible from outside of the wall switch box by way of the central aperture in an ordinary wall switch cover plate WSCP.

Details of Operation

Figure 1:
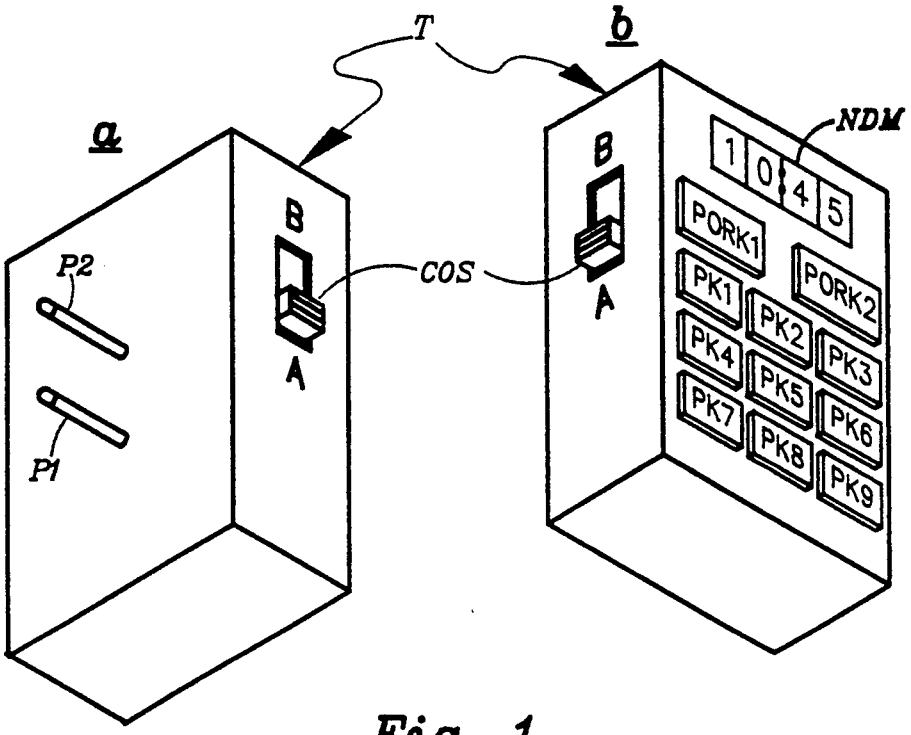
FIG. 1 shows the programmable wall switch plug-in timer in two perspective views.

With reference to FIGS. 1, 2 and 3, the overall operation of the timer may be explained as follows.

The timer may be programmed by way of programming keys K1 to K9 to cause the IC to actuate and/or de-actuate the DC motor in such a way as to cause contactor assembly CA to make and/or break electrical contact between contact terminals CT1 and CT2, and thereby between prong terminals PT1 and PT2 (as long as cut-out switch COS is in its closed position, which is the position marked by the letter A), in accordance with a desired time pattern; which time pattern will then automatically repeat every 24-hour period.

Thus, if the timer is plugged into the special receptacle in wall switch box WSB, the load connected with the wires entering this wall switch box will be connected and/or disconnected in accordance with the desired time pattern; which implies that the power provided to the load being connected with the two wires entering the wall switch box will be correspondingly controlled.

With reference to FIG. 2, when the DC motor is provided with a DC voltage across its electrical input terminals, the motor's output shaft will rotate. The rotating motor shaft will, by way of the indicated gear train, cause eccentric means EM to rotate, thereby actuating contactor assembly CA, as well as switch means SM, once for each revolution of EM. At a first point during each revolution, just before contactor lever CL1 is about to make electrical connection with contactor lever CL2, switch means SM opens; at a second point during each revolution, just before contactor lever CL1 is about to provide for electrical disconnection from contactor lever CL2, switch means SM closes. Each time switch means SM opens or closes, it provides a command to the IC to discontinue providing power to the motor.

Programming of the timer is accomplished as follows.

a) Current time-of-day is programmed into the clock by first momentarily depressing PK3, and then by depressing the hour-roll key PK1 and the minute-roll key PK2 until the correct hour and minute are displayed on the numeric display means NDM. After correct current time-of-day is reached, PK3 is depressed once more, thereby securing the time-of-day setting.

b) A first time-of-day for the load to be switched ON is established by: i) momentarily depressing PK4; ii) by way of PK1 and PK2, selecting the first desired time-of-day at which the load should be turned ON; and iii) momentarily depressing PK4 again, thereby securing this particular instruction.

c) A first time-of-day for the load to be switched OFF is established by: i) momentarily depressing PK5; ii) by way of PK1 and PK2, selecting the first desired time-of-day at which the load should be turned OFF; and iii) momentarily depressing PK5 again, thereby securing this particular instruction.

d) A second time-of-day for the load to be switched ON and a second time-of-day for the load to be switched OFF can be programmed into the timer by way of the PK6 key and the PK7 key, respectively, in the same manner as described above relative to the PK4 key and the PK5 key.

e) The PK8 key and the PK9 key may be used for providing various effects relating to time-variability of the keyed-in program. However, these effects have no relationship with the present invention.

f) During the process of selecting a given time-of-day for an ON-switching or an OFF-switching to occur, the numeric display means provides for a display of the time-of-day being selected. After the selection has been accomplished and secured, however, the numeric display means reverts back to displaying current time-of-day.

g) The PORK1 key and the PORK2 key are permanently programmed. After depressing the PORK1 key, the timer will be in the ON-state, regardless of the state in which it previously existed; after depressing the PORK2 key, the timer will be in its OFF-state, regardless of the state in which it previously existed.

Otherwise, the following details with respect to the timer's operation should be noted.

h) The positioning of switch means SM relative to eccentric means EM is important, not only to achieve accuracy in the actuation of contactor assembly CA, but also for the purpose of minimizing actuation time. Ideally, switching of the load should occur immediately upon command. Yet, due to the limited speed/power of the DC motor, a certain time is required to effect actuation of the contactor assembly. By positioning switch means SM optimally, actuation time can be made acceptably brief.

i) In its preferred embodiment, subject timer has a built-in 24-hour cycle; which is to say that whatever switching control pattern that is programmed into this timer will automatically repeat every 24 hours. However, it is readily possible to provide for other programming periods. For instance, in many cases a seven-day cycle would be advantageous.

It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

I claim:

1. An arrangement comprising:

a wall switch box into which is coming a pair of first conductor means; the first conductor means being: (i) connected with a load and the power line voltage of an ordinary electric utility power line; and (ii) operative, when electrically short-circuited together, to cause said power line voltage to be applied across the load;

a face plate covering the wall switch box; the face plate having an aperture; and a programmable timer means mounted outside of the face plate; the timer means having a pair of second conductor means connected by way of said aperture with the pair of first conductor means; the timer means being operative periodically to cause a short circuit to occur between the pair of second conductor means, thereby correspondingly: (i) to cause a short circuit periodically to occur between the pair of first conductor means, and (ii) periodically to energize said load; the programmable timer means being operative as stated without having to be connected with terminals having the power line voltage provided thereacross;

the arrangement being further characterized by having no parts exhibiting movement between a first point in time at which such a short circuit is caused to occur and a second point in time at which this short circuit cease to exist.

2. A combination comprising:

a wall switch box inside of which is a first pair of conductors;

a face plate covering the wall switch box; the face plate having an aperture; and a programmable timer mounted outside of the face plate; the timer having a second pair of conductors; the second pair of conductors being connected with the first pair of conductors by way of the aperture; the timer being operative periodically to cause a short circuit to occur between the second pair of conductors, thereby correspondingly to cause a short circuit periodically to occur between the first pair of conductors; the programmable timer means including battery means;

the combination being further characterized by having no parts exhibiting movement between a first point in time at which such a short circuit is caused to occur and a second point in time at which this short circuit ceases to exist.

3. A combination comprising:

a wall switch box inside of which is a pair of first conductors;

a face plate covering the wall switch box; the face plate having an central aperture; and a programmable timer located outside of the face plate; the timer having a pair of second conductors; the pair of second conductors protruding through the central aperture to connect with the pair of first conductors; the timer being operative periodically to cause a short circuit to occur between the pair of second conductors, thereby correspondingly to cause a short circuit to occur periodically between the pair of first conductors;

the combination being further characterized by having no parts exhibiting movement between a first point in time at which such a short circuit is caused to occur and a second point in time at which said short circuit ceases to exist.

4. A combination comprising:

a wall switch box inside of which is a pair of first conductors; the wall switch box being of a type commonly used in combination with an ordinary wall switch; the first conductors being connected, externally of the wall switch box, with a lighting means as well as the conductors of an ordinary electric utility power line;

a face plate covering the wall switch box; the face plate having an aperture; and a programmable timer located outside of the face plate; the timer having a pair of second conductors; the pair of second conductors extending through the aperture to connect with the pair of first conductors; the timer being operative periodically to cause electrical connection to occur between the pair of second conductors, thereby correspondingly to cause electrical connection to occur periodically between the pair of first conductors;

the combination being further characterized by having no parts exhibiting movement between a first point in time at which an electrical connection is caused to occur and a second point in time at which this electrical connection ceases to exist.

5. A combination comprising:

a wall switch box inside of which is a pair of first conductors;

a face plate covering the wall switch box; the face plate having a central aperture; and a programmable timer located outside of the face plate; the timer having a pair of second conductors; the pair of second conductors extending through the central aperture to connect with the pair of first conductors; the timer being operative periodically to cause electrical connection to occur between the pair of second conductors, thereby correspondingly to cause electrical connection to occur periodically between the pair of first conductors; the programmable timer further including: (i) programming means operable to accept manual programming instructions, (ii) electrically actuatable switch means, and (iii) control means operative periodically to supply an electric actuation signal to the switch means;

the combination being further characterized by having no parts exhibiting movement between a first point in time at which an electrical connection is caused to occur and a second point in time at which this electrical connection ceases to exist.

6. The combination of claim 5 wherein the programmable timer includes a clock means capable of functioning without being connected with said first pair of conductors.

7. The combination of claim 5 wherein the programmable timer is operative as defined without requiring any conductor means other than said pair of second conductors extending through the aperture.

8. The combination of claim 5 wherein the programmable timer is characterized by comprising a quartz element.

9. The combination of claim 5 wherein the programmable timer is characterized by including mechanically actuated switch means.

10. The combination of claim 5 wherein the programmable timer is characterized by including an electric battery means.

11. The combination of claim 5 wherein the programmable timer is characterized by including a DC motor means.

12. The combination of claim 5 wherein the programmable timer is operative as defined without having to be connected with a power source external thereof.

13. The combination of claim 5 wherein the programmable timer is characterized by including clock means operable to function without having to be connected with the AC power line voltage of an electric utility power line.

14. The combination of claim 5 wherein the programmable timer is characterized by including alphanumeric display means.

15. The combination of claim 5 wherein said pair of first conductors represents a single leg of an ordinary power line.

16. The combination of claim 5 wherein said pair of first conductors includes a pair of electric terminals connected in series with a load and the AC power line voltage of an ordinary electric utility power line; such that, when an electrical short circuit exists between the pair of electric terminals, the load is provided with the AC power line voltage.

17. The combination of claim 5 wherein said face plate is of a type commonly used with an ordinary wall switch.

18. The combination of claim 5 wherein the programmable timer is characterized by including integrated circuit means.

19. The combination of claim 5 wherein the programmable timer is characterized by including a manual switch means.

20. A combination comprising:

a wall switch box into which extend a pair of first conductors having a pair of electrical terminals;

a face plate covering the wall switch box; the face plate having an aperture; and a programmable timer located outside of the face plate; the timer having a pair of second conductors; the pair of second conductors extending through the aperture to connect with the pair of electrical terminals; the timer being operative periodically to cause electrical connection to occur between the pair of second conductors, thereby correspondingly to cause electrical connection to occur periodically between the pair of first conductors;

the combination being further characterized by having no parts exhibiting movement between a first point in time at which an electrical connection is caused to occur and a second point in time at which this electrical connection ceases to exist.

21. The arrangement of claim 20 wherein the programmable timer includes a manual override switch by which to permit a person at any time to cause disconnection between the pair of first conductors.

22. The arrangement of claim 20 wherein the programmable timer is further characterized by including a battery and a DC motor; the battery having a DC voltage; the DC motor being only intermittently connected with the DC voltage of the battery.

23. An arrangement comprising:

a wall switch box into which is coming a pair of first conductor means; the first conductor means being: (i) connected with a load and the power line voltage of an ordinary electric utility power line; and (ii) operative, when electrically connected together, to cause said power line voltage to be applied across the load;

a face plate covering the wall switch box; the face plate having a central aperture; and a programmable timer means mounted outside of the face plate; the timer means having a pair of second conductor means connected by way of said central aperture with the pair of first conductor means; the timer means being characterized by having: (i) programming means operable to accept manual programming instructions, (ii) electrically actuatable switch means, and (iii) control means operative periodically and intermittently to supply an electric actuation signal to the switch means;

the arrangement being further characterized by having no parts exhibiting movement between a first point in time at which an electrical connection is caused to occur and a second point in time at which this electrical connection ceases to exist.

24. The arrangement of claim 23 wherein the programmable timer means additionally includes manual switch means operative at any time to cause disconnection between the pair of second conductor means.

25. A combination comprising:

a wall switch box inside of which is a first pair of conductors;

a face plate covering the wall switch box; the face plate having an aperture located approximately in the center thereof; and a programmable timer mounted outside of the face plate; the timer having a second pair of conductors; the second pair of conductors being connected with the first pair of conductors by way of the central aperture; the timer being operative periodically to cause an electrical connection to occur between the second pair of conductors, thereby correspondingly to cause an electrical connection periodically to occur between the first pair of conductors;

the combination being further characterized by having no parts exhibiting movement between a first point in time at which an electrical connection is caused to occur and a second point in time at which this electrical connection ceases to exist.

26. An arrangement comprising:

a wall switch box into which is coming a pair of first conductors; the first conductors being: (i) connected with a load and the power line voltage of an ordinary electric utility power line; and (ii) operative, when electrically connected together, to cause said power line voltage to be applied across the load;

a face plate covering the wall switch box; the face plate having a central aperture; and a programmable timer mounted outside of the face plate; the timer having a pair of second conductors connected by way of the central aperture with the pair of first conductors; the programmable timer being operative periodically and alternatingly to cause electrical connection and disconnection to occur between the pair of second conductors;

the arrangement being further characterized by having no parts exhibiting movement between a first point in time at which electrical connection is caused to occur and a second point in time at which electrical disconnection is caused to occur.

27. The arrangement of claim 26 wherein said electrical connection is effected by way of mechanically actuated contactor means.

28. The arrangement of claim 26 wherein only two conductors penetrate through the central aperture.

29. The arrangement of claim 26 wherein the face plate has two apertures in addition to the central aperture; the two additional apertures being located on opposite sides of the central aperture.

30. The arrangement of claim 26 wherein the face plate is an ordinary wall switch cover plate.

31. The arrangement of claim 26 wherein the programmable timer is additionally characterized by including a clock means operative to provide a time-of-day basis for programming the programmable timer to perform the periodic electrical connections and disconnections; the clock means being characterized by not requiring an electric motor for providing said time-of-day basis.

32. The arrangement of claim 26 wherein the programmable timer is mounted at the face plate in lieu of an ordinary manually actuatable switch means.

33. The arrangement of claim 26 wherein, when mounted outside the face plate, the programmable timer covers but a part of the frontal area of the face plate.

34. The arrangement of claim 26 wherein, when mounted outside the face plate, the programmable timer covers the central aperture while projecting said pair of second conductors therethrough.

35. The arrangement of claim 26 wherein the programmable timer includes an over-ride actuator switch functional to permit a person at any time to effect disconnection between the load and the power line voltage.

36. The arrangement of claim 26 wherein: (i) in addition to the central aperture, the face plate has at least one hole by way of which it may be fastened to the wall switch box; and (ii) when mounted outside the face plate, the programmable timer is operative to prevent said at least one hole from being seen by a person standing in front of the programmable timer.

37. The arrangement of claim 26 wherein the programmable timer consists of a housing and a plurality of other component parts; which other component parts are all contained within the housing and/or attached thereto.

38. The arrangement of claim 26 wherein said electrical connection is effected by way of metal-to-metal contacts.

39. The arrangement of claim 26 wherein the programmable timer is characterized by including a quartz element operative to permit accurate time-keeping and programming even if not having connection with the power line voltage.

40. An arrangement comprising:

a programmable timer mounted within a housing having a pair of electrical prongs protruding therefrom; the programmable timer being characterized by: (i) having a plurality of component parts, including a pair of contactor terminals; (ii) being operative periodically and alternatingly, by way of physical movement of some of its component parts, to cause electrical connection and disconnection to occur between the contractor terminals; and (iii) exhibiting substantial periods during which none of its component parts exhibits physical movement;

a receptacle operable to receive and hold the pair of electrical prongs, thereby causing the programmable timer to be supported by the receptacle; the receptacle having a pair of conductors connected in circuit with an ordinary electric utility power line; the conductors being electrically connected with the electrical prongs whenever these prongs have indeed been received by the receptacle; and an electrical load connected in circuit with the programmable timer and the receptacle, thereby periodically to be connected with said power line.

41. The arrangement of claim 40 wherein the programmable timer is further characterized by including a battery and an electric motor; the electric motor being powered by the battery, but not during said substantial periods.

42. The arrangement of claim 40 wherein the programmable timer is further characterized by including a battery and an electric motor; the electric motor being powered by the battery, but only intermittently.

43. The arrangement of claim 40 wherein the programmable timer is further characterized by consisting of said plurality of component parts; which plurality of component parts includes the housing and the pair of electrical prongs.

44. The arrangement of claim 40 wherein the programmable timer is further characterized by including a battery and an electro-magnetic actuator means operative to cause physical movement of the contactor terminals; the electro-magnetic actuator means being powered by the battery, but not during said substantial periods.

45. The arrangement of claim 40 wherein the receptacle is combined with and mounted at a wall switch box.

46. The arrangement of claim 45 wherein an ordinary wall switch face plate is interposed between wall switch box and the programmable timer.

47. The arrangement of claim 45 wherein: (i) the wall switch box is covered by a face plate having a central aperture; and (ii) the receptacle is mounted in alignment with the central aperture.

48. The arrangement of claim 40 wherein the receptacle is mounted substantially within a box into which come at least two electrical wires; which electrical wires are connected in circuit with the power line as well as with said conductors, thereby to cause said conductors to be connected in circuit with the power line.

49. An arrangement comprising:

a programmable timer mounted in a housing having a pair of electrical prongs protruding therefrom; the programmable timer being characterized by: (i) consisting of a plurality of component parts, including a pair of contactor terminals; (ii) being operative periodically and alternatingly, by way of physical movement of at least one of its component parts, to cause electrical connection and disconnection to occur between the contactor terminals; and (iii) exhibiting extensive intervals during which none of its component parts exhibits physical movement; and a receptacle operable to receive and hold the pair of electrical prongs, thereby causing the programmable timer to be supported by the receptacle; the receptacle having a pair of conductors connected in circuit with an ordinary electric utility power line; the conductors being electrically connected with the electrical prongs whenever these prongs have indeed been received by the receptacle;

whereby an electrical load connected in circuit with the programmable timer and the receptacle to be periodically connected with said power line.

* * * * *